US006656013B1

(12) United States Patent
Wang

(10) Patent No.: US 6,656,013 B1
(45) Date of Patent: Dec. 2, 2003

(54) BRASSIERE STRING ASSEMBLY

(76) Inventor: Wen-Da Wang, No. 9-1, Shin Ho 2 Road, Tainan (TW)

( * ) Notice: Subject to any disclaimer, the term of this patent is extended or adjusted under 35 U.S.C. 154(b) by 0 days.

(21) Appl. No.: 10/173,505

(22) Filed: Jun. 18, 2002

(51) Int. Cl.[7] ..... A41C 3/00
(52) U.S. Cl. ..... 450/86; 2/244; D2/700
(58) Field of Search ..... 2/326, 327, 336, 2/338, 244, 246, 67, 69, 105, 106, 80, 83, 73, 78.1–78.3; 450/81, 88, 86, 1; 428/15–19; D2/626, 639, 640, 700–703, 705–708, 731, 734, 736, 737, 605, 607, 609; 24/5, 3, 12, 71 CT, 68 T, 68 AS, 712, 713, 712.5, 115 R, 122.6, 127, 136 R, 136 L; 63/3, 3.1, 3.2; 224/257–260

(56) References Cited

U.S. PATENT DOCUMENTS 2,849,723 A * 9/1958 Marino ..... 2/323
3,311,112 A * 3/1967 Murray ..... 450/86
3,935,865 A * 2/1976 Newmar ..... 450/86
5,416,928 A * 5/1995 Koenig ..... 2/244
6,186,861 B1 * 2/2001 Flaherty ..... 450/1
6,517,409 B2 * 2/2003 Flaherty ..... 450/1

* cited by examiner

*Primary Examiner*—Gloria M. Hale
(74) *Attorney, Agent, or Firm*—Rosenberg, Klein & Lee

(57) ABSTRACT

A brassiere string assembly includes a brassiere string, an adjusting ring, two buckle rings and at least two slidable blocks. The string is elastic and made of transparent material, TPU. The adjusting ring is provided with at least four small holes in one half and at least two big holes in the other half. Each buckle ring is provided with at least two through holes in the upper section. Each slidable block is provided with a vertical hole respectively at both sides, and an ornamental article is provided on the outward surface of each slidable block.

2 Claims, 4 Drawing Sheets

BRASSIERE STRING ASSEMBLY

BACKGROUND OF THE INVENTION

1. Field of the Invention

The present invention relates to a brassiere string assembly which is colorful and made of transparent thermoplastic polyurethane (TPU), and whose string is elastic, so as to make a wearer feel comfortable; more particularly to a brassiere string assembly which is provided with at least two ornamental slidable blocks, so as to make the brassiere string assembly look vivid, glittering and beautiful.

2. Description of the Related Art

Ladies today are becoming more and more tasteful about brassieres. They pay much attention to the practical effect of comfort, protection and the support of the brassiere body.

Referring to FIG. 1, although the brassiere body 10 has been constantly improved, the conventional brassiere straps 20 have been ignored by brassiere manufacturers and users, so that the straps keep the same style and continue to be made of cotton or fiber. They lack an ornamental visual effect.

Moreover, the conventional brassiere straps 20 are made of cotton or fiber, and they contact with a wearer's skin by a lot of areas. Therefore, after the conventional brassiere straps, 20 have been worn by a wearer for a period of time, especially after the wearer has been sweated, the wearer's skin where contacts with the brassiere straps 20 will feel unwell and even become allergenic or inflamed because the brassiere straps 20 are not ventilated.

Modern women would like to add various ornaments on their clothes, so as to become more fashionable. Modern women of the "e-generation" would have another fashion choice if brassiere straps 20 were improved with some creativity.

SUMMARY OF THE INVENTION

Therefore, it is an object of the present invention to provide a brassiere string assembly that substantially obviates the drawbacks of conventional brassieres.

An object of the present invention is to provide a brassiere string assembly which is elastic, ventilated and has little contact surface with a wearer's skin, so as to make a wearer feel comfortable.

Another object of the present invention is to provide a brassiere string assembly which is made of a transparent TPU, may be colorful and is provided with at least two ornamental slidable blocks, so as to make the brassiere string look vivid, glittering and beautiful.

Accordingly, a brassiere string assembly of the present invention includes a brassiere string, an adjusting ring, two buckle rings and at least two slidable blocks. The string is elastic and made of transparent material, TPU. The adjusting ring is provided with at least four small holes in one half and at least two big holes in the other half. Each buckle ring is provided with at least two through holes in the upper section. Each slidable block is provided with a vertical hole respectively at both sides, and an ornamental article is provided on the outward surface of each slidable block.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
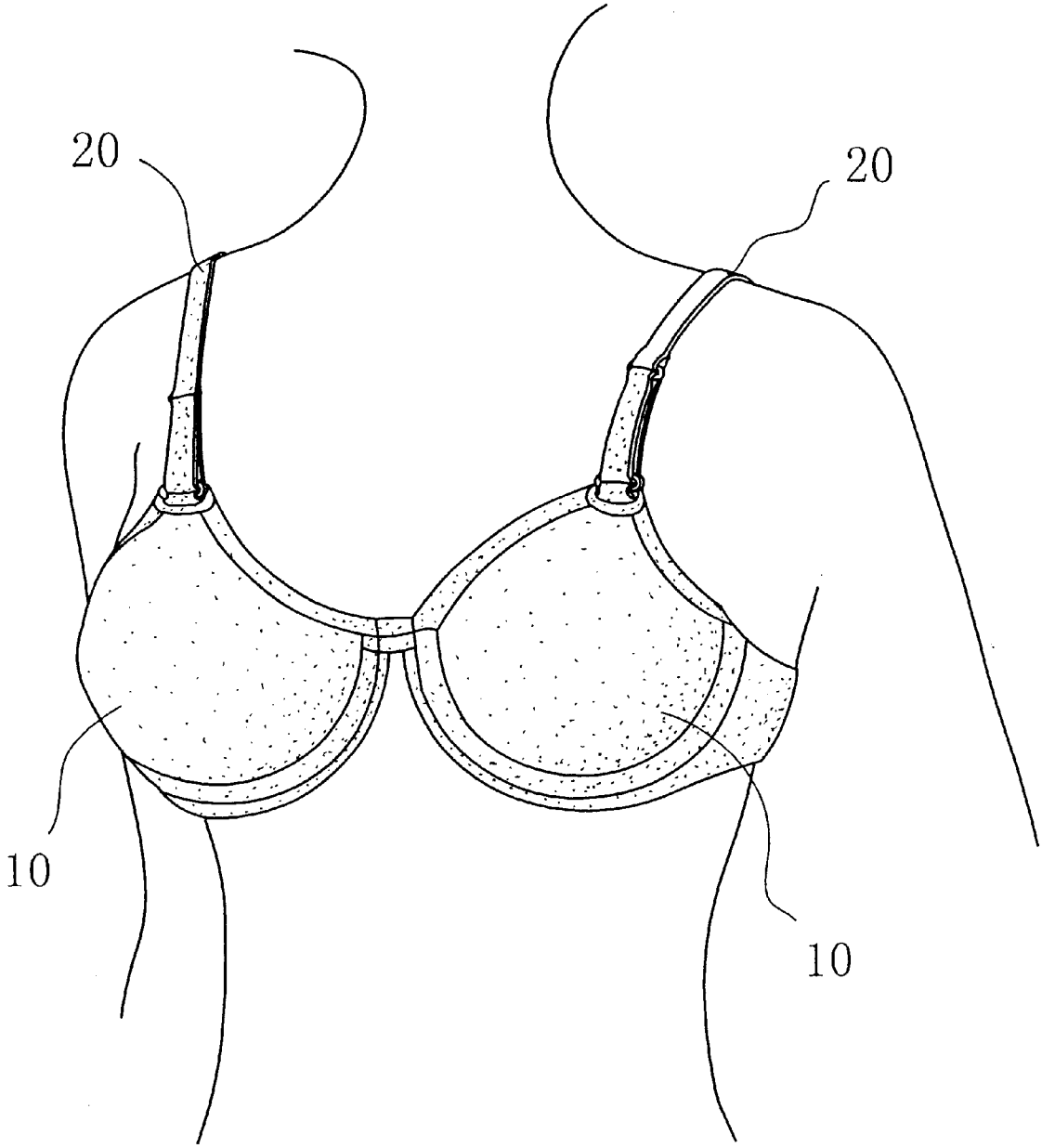
FIG. 1 (PRIOR ART)
FIG. 1 is a perspective view of conventional brassiere straps assembled to a brassiere worn by a wearer.
Figure 2:
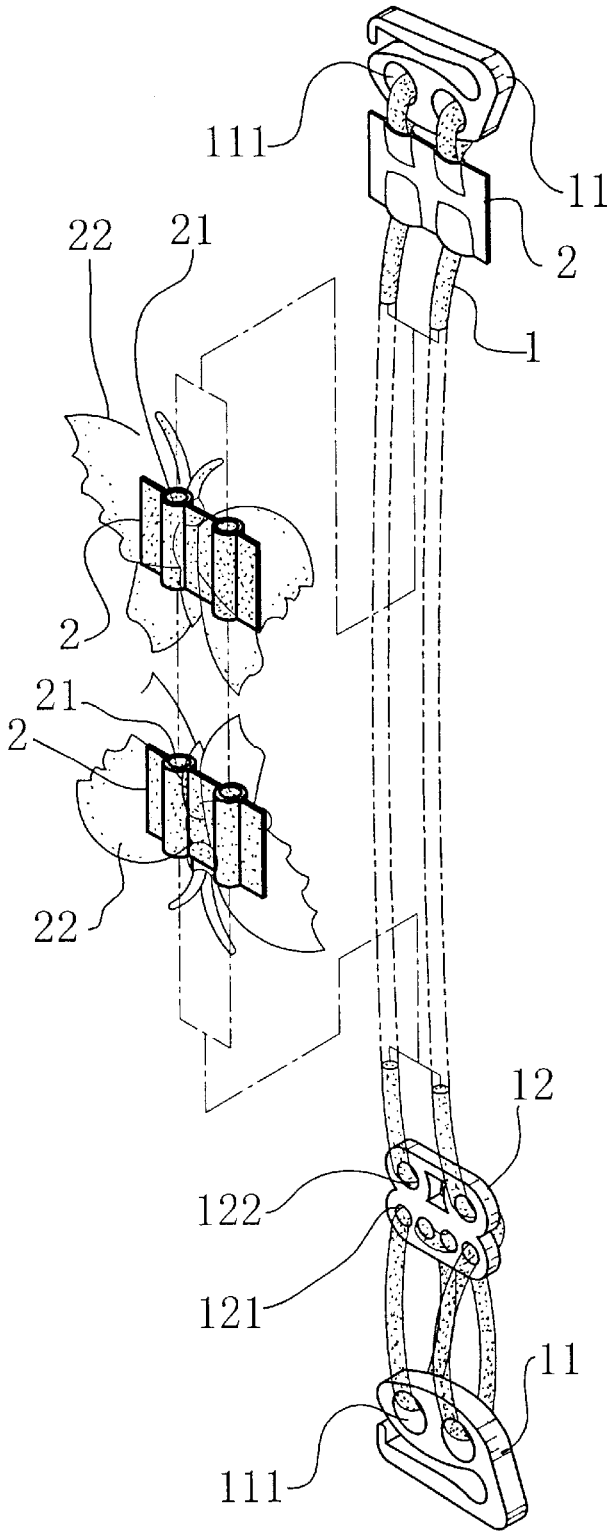
FIG. 2 is a perspective exploded view of an embodiment of the brassiere string assembly in accordance with the present invention.
Figure 3:
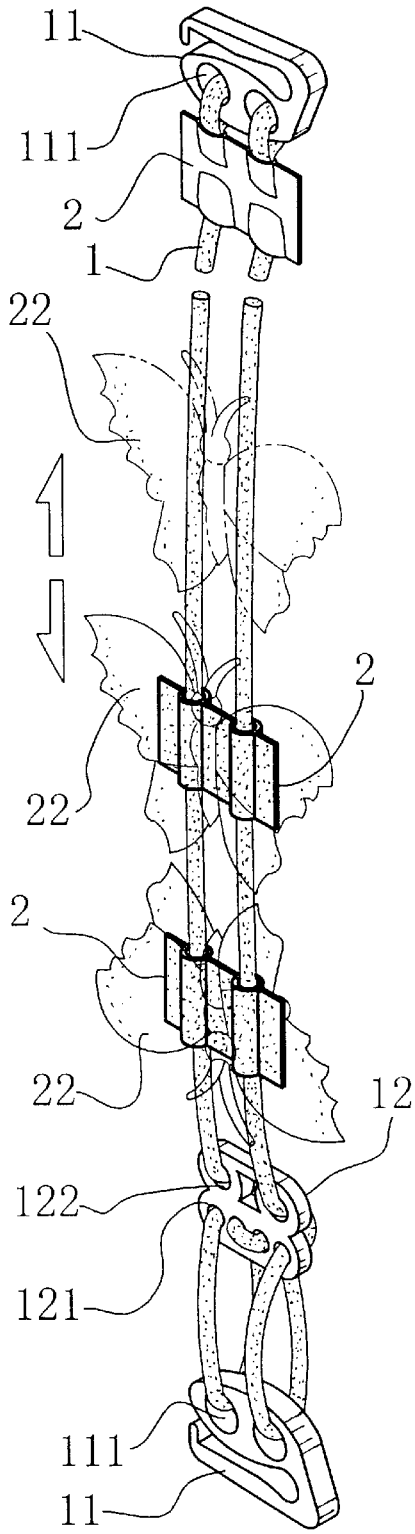
FIG. 3 is a perspective schematic view of an embodiment of the brassiere string assembly in an assembled configuration and showing the slidable blocks being moved on the string in accordance with the present invention.
Figure 4:
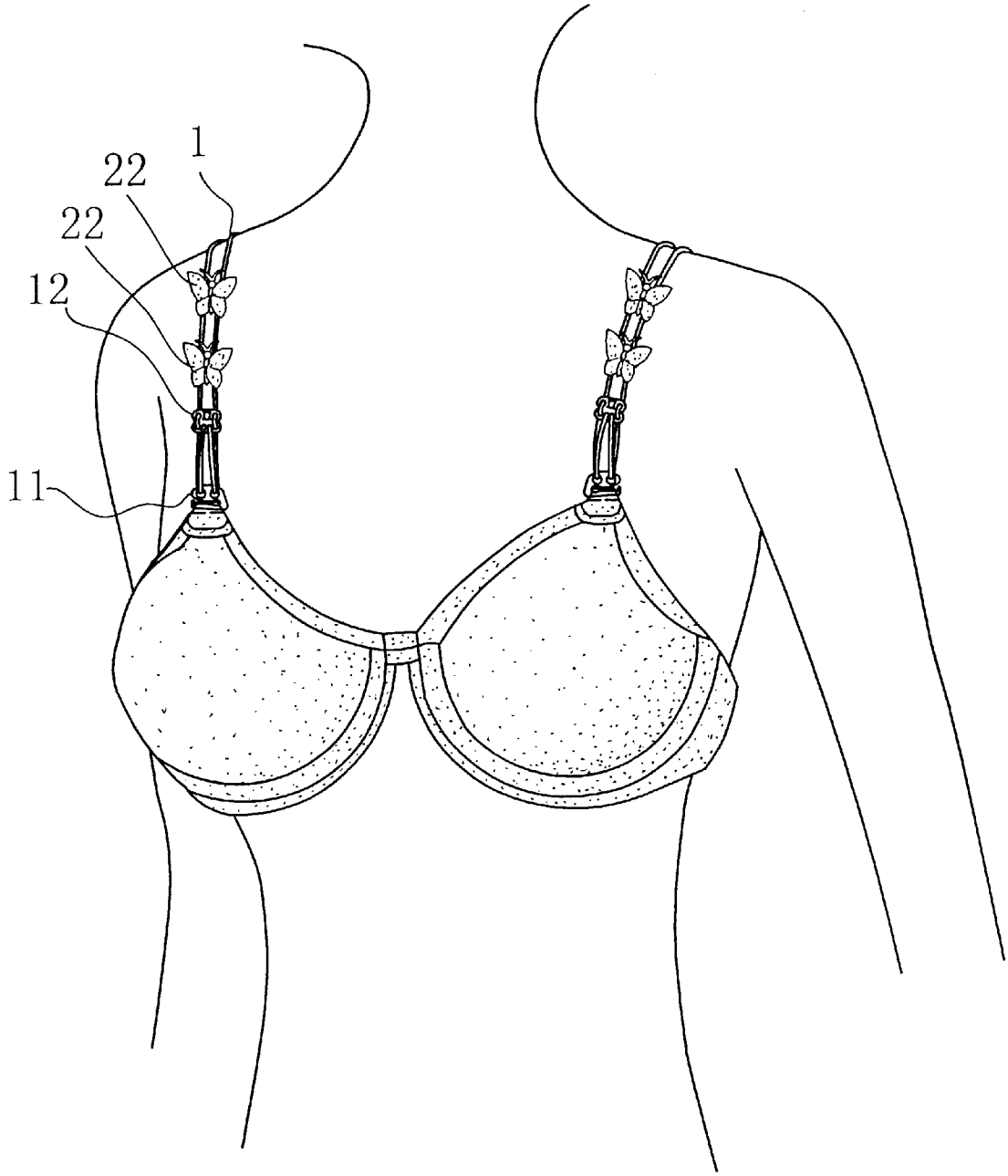
FIG. 4 is a perspective view of an embodiment of the brassiere string assembly in accordance with the present invention assembled to a brassiere worn by a wearer.

Referring to FIGS. 2,3 and 4, a preferred embodiment of a brassiere string assembly in the present invention includes a brassiere string 1, two buckle rings 11, an adjusting ring 12, and at least two slidable blocks 2. The string 1 is elastic, made of transparent thermoplastic polyurethane (TPU) and may be colorful.

Each buckle ring 11 is provided with at least two through holes 111 in the upper section. The adjusting ring 12 is provided with at least four small holes 121 in one half and at least two big holes 122 in the other half.

Figure 5:
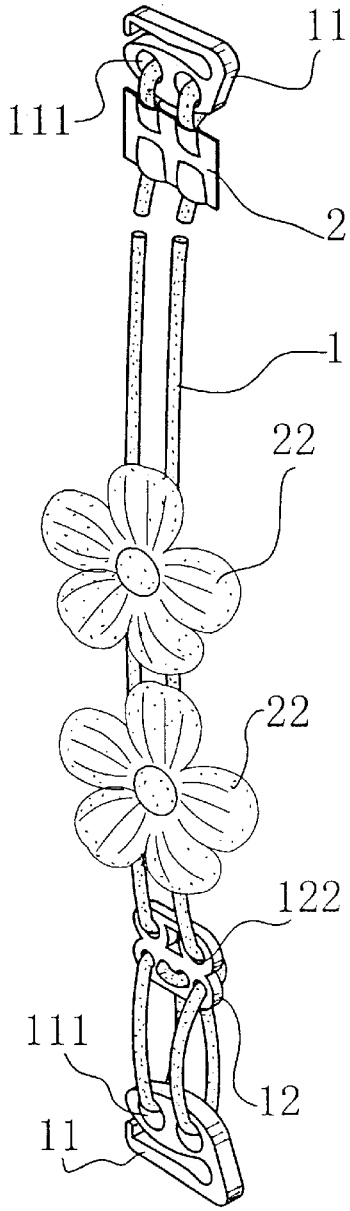
FIG. 5 is a perspective view of the brassiere string assembly with another embodiment of the ornamental article on each slidable block in accordance with the present invention.
Figure 6:
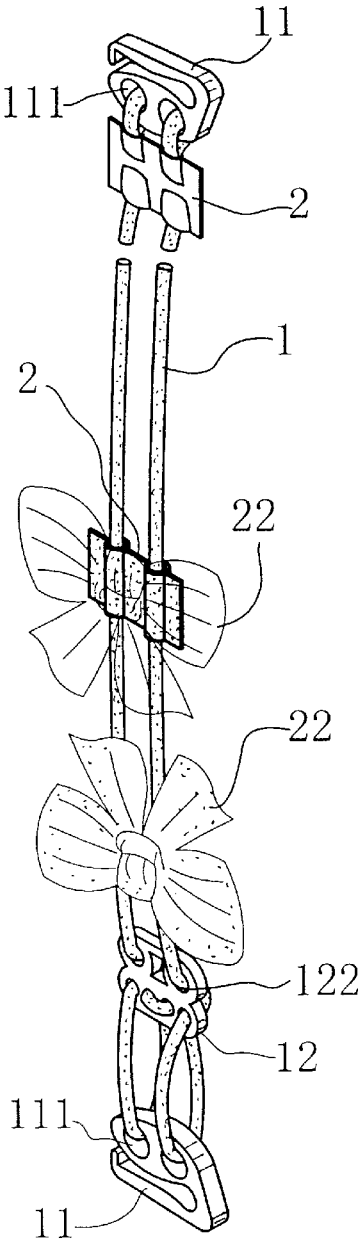
FIG. 6 is a perspective view of the brassiere string assembly with one more embodiment of the ornamental article on each slidable block in accordance with the present invention; and, FIG. 7 is a perspective view of the brassiere string assembly with one more embodiment of the ornamental article on each slidable block in accordance with the present invention.
Figure 7:
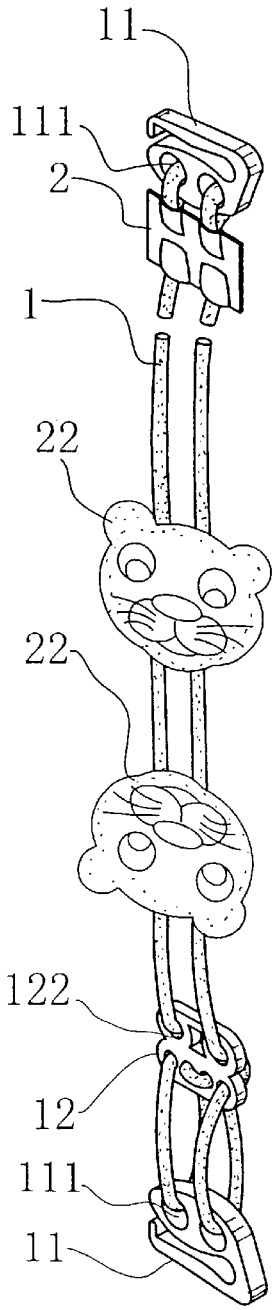

Each slidable block 2 is provided with a vertical hole 21 respectively at both sides, and an ornamental article 22 is provided on the outward surface of each slidable block 2. Each ornamental article 22 may be any kind of configuration, Such as animals, plants, cartoon figures, etc, referring to FIGS. 5, 6 and 7.

While being assembled, referring to FIG. 3, both ends of the brassiere string 1 are respectively passed through the central two small holes 121 in one half of the adjusting ring 12, respectively passed through the two through holes 111 of one buckle ring 11, and then successively passed the rest outer small holes 121 and the two big holes 122 of the adjusting ring 12. Finally, after both ends of the brassiere string 1 are respectively passed through the vertical holes 21 of each slidable block 2 and the two through holes 111 of the other buckle ring 11, both ends of the brassiere string 1 are attached to a predetermined portion of the nearest slidable block 2, pressed together and joined with high frequency energy, so as to finish the vivid, glittering and beautiful brassiere string assembly.

While the preferred embodiments of the invention have been described above, it will be recognized and understood that various modifications may be made therein,and the appended claims are intended to cover all such modifications which may fall within the spirit and scope of the invention.

What is claimed is:

1. A brassiere string assembly comprising:

a brassiere string, being elastic, colorful, made of transparent thermoplastic polyurethane (TPU);

two buckle rings, each said buckle ring being provided with at least two through holes in an upper section;

an adjusting ring being provided with at least four small holes in one half and at least two big holes in an other half; and, at least two slidable blocks, each said slidable block being provided with a vertical hole respectively at both sides, and an ornamental article being provided on an outward surface of each said slidable block.

2. The brassiere string assembly, as recited in claim 1, wherein each said ornamental article is in any kind of configuration, such as animals, plants, cartoon figures.

* * * * *